US005090273A

United States Patent [19]

Fossella

[11] Patent Number: 5,090,273

[45] Date of Patent: Feb. 25, 1992

[54] ADJUSTABLE RATCHET WRENCH

[76] Inventor: Gregory Fossella, 97 Main St., P.O. Box 838, Osterville, Mass. 02655

[21] Appl. No.: 567,290

[22] Filed: Aug. 14, 1990

Related U.S. Application Data

[63] Continuation-in-part of Ser. No. 387,220, Jul. 28, 1989, abandoned.

[51] Int. Cl.[5] ..... B25B 17/00

[52] U.S. Cl. ..... 81/57.13; 81/63.2; 81/57.11

[58] Field of Search ..... 81/57.11, 57.13, 58.4, 81/60-63.2, 128

[56] References Cited

U.S. PATENT DOCUMENTS

| | | | |
|---|---|---|---|
| 877,773 | 1/1908 | Holm . | |
| 912,117 | 2/1909 | Green | 87/128 |
| 915,443 | 3/1909 | Jones | 87/128 |
| 1,000,277 | 8/1911 | McCoy | 87/62 |
| 1,074,594 | 10/1913 | Andersen | 87/62 |
| 1,274,337 | 7/1918 | Schwartz | 87/62 |
| 1,450,641 | 1/1923 | Ognabisz . | |
| 2,580,247 | 12/1951 | Secondi et al. . | |
| 2,979,089 | 4/1961 | Piesker | 81/57.11 |
| 3,377,893 | 4/1968 | Shomb . | |
| 3,664,213 | 5/1972 | Anati . | |
| 4,524,649 | 6/1985 | Diaz et al. | 81/57.13 |

OTHER PUBLICATIONS

"Instruction Manual ¼" Cordless Ratchet 6080", Black & Decker, 1988.

"Skil Operating Guide, Model 2238 Cordless Power Wrench", Skil Corporation.

*Primary Examiner*—James G. Smith

*Attorney, Agent, or Firm*—Wolf, Greenfield & Sacks

[57] ABSTRACT

An adjustable ratchet wrench has a housing carried by a handle. The housing has a generally cylindrical chamber which carries a mounting disk which in turn supports three equidistantly spaced jaws. The mounting disk is connected to the handle by a ratchet assembly whose setting determines the direction in which the tool may be turned to turn the nut or other workpiece. The housing also carries a cam disk that engages the jaws and opens and closes them depending upon the direction in which it is rotated. A second ratchet mechanism determines the direction in which the cam disk may be rotated with respect to the mounting disk so as to open and close the jaws.

In one embodiment, a power pack, motor and gears are mounted in the handle for automatically driving the mounting disk to turn the work engaged by the handle.

23 Claims, 8 Drawing Sheets

ADJUSTABLE RATCHET WRENCH

RELATED APPLICATION

The application is a continuation-in part of my prior copending application Ser. No. 07/387220 filed July 28, 1989 entitled Adjustable Ratchet Wrench, now abandoned.

INTRODUCTION

This invention relates to ratchet wrenches and more particularly comprises a new and improved adjustable ratchet wrench capable of use with a large range of sizes of nuts and bolts.

Most conventional ratchet wrenches in use today require a large number of interchangeable heads so as to accommodate workpieces of different diameters. For example, approximately 41 different heads are required to accommodate both standard and metric sizes within the range of from 5/16 to 1 inch in diameter. An additional equal number of heads may be required if deep bolt clearance is necessary for the work to be performed. A complete set of sockets is expensive, bulky and heavy to carry about, and are very easily lost.

The principal object of the present invention is to provide an adjustable ratchet-type socket wrench capable of accommodating a wide range of sizes of nuts and bolts.

Another important object of the present invention is to provide a adjustable ratchet-type socket wrench which has an open center so as to provide deep bolt clearance.

Yet another important object of the present invention is to provide an adjustable ratchet-type socket wrench which may not only be used directly on work but may be used in combination with other tools such as screwdrivers and standard square drive socket extension bars, sockets and other square drive accessories.

Another important object of the present invention is to provide an adjustable ratchet wrench that accomplishes all of the foregoing objects and is motor driven.

To accomplish these and other objects the adjustable ratchet wrench of the present invention has three radially moveable jaws that may be moved toward and away from one another by means of a rotatable cam disk carried on the head of the tool and which is controlled by a conveniently placed rocker pawl on the upper surface of the head of the tool and that forms part of a first ratchet mechanism. A second ratchet mechanism controls the drive direction of the head with respect to the handle so that the work may be rotated either clockwise or counterclockwise. The tool is open through the center so that a nut can be screwed onto a shaft or other member of any length and to any depth.

In accordance with one of the embodiments of the present invention, a motor and gear drive are mounted in the handle for rotating the head with respect to the handle to turn the bolt or nut engaged by the jaws or to rotate a second tool to be driven by the ratchet wrench of the present invention. A control is mounted on the handle for determining the direction of rotation of the head when driven by the motor and for positioning the second ratchet mechanism.

These and other objects and features cf the present invention will be better understood and appreciated from the following detailed description of one embodiment thereof, selected for purposes of illustration and shown in the accompanying drawings.

BRIEF FIGURE DESCRIPTION

DETAILED DESCRIPTION

Figure 2:
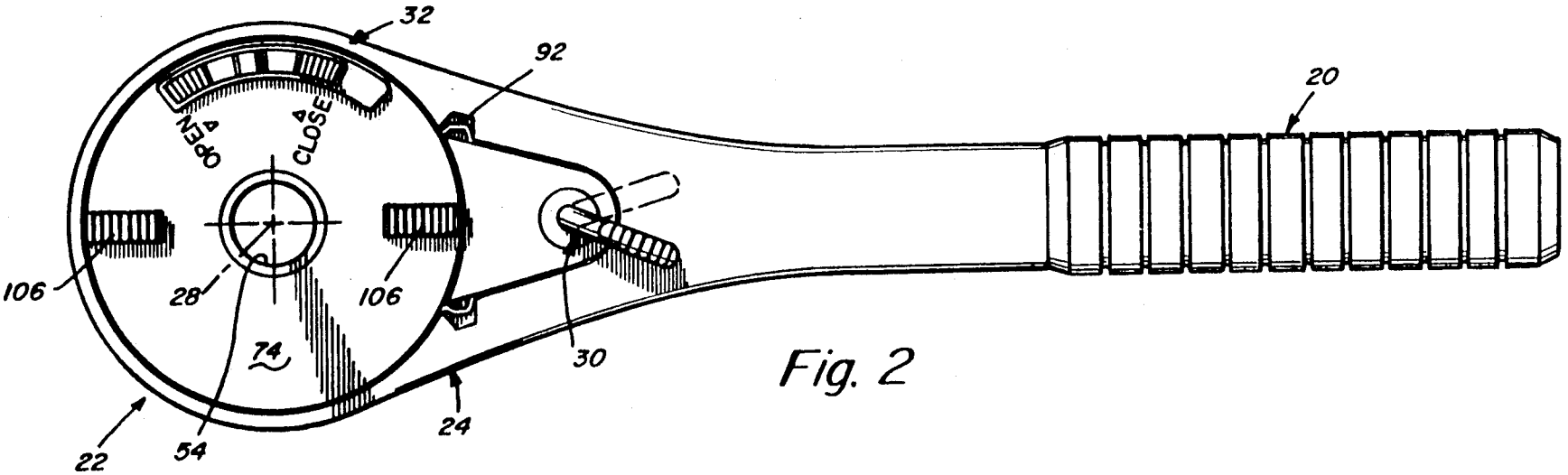
FIG. 2 is a top view thereof.
Figure 1:
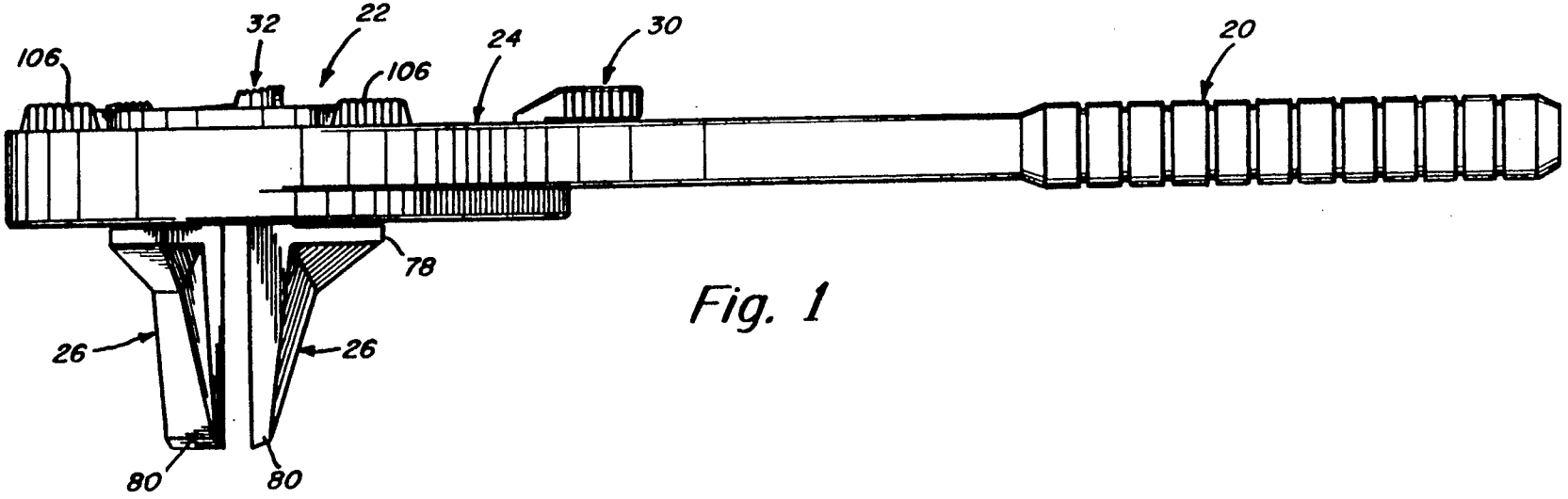
FIG. 1 is a side view of an adjustable ratchet wrench constructed in accordance with this invention.

The adjustable ratchet wrench shown in the FIGS. 1-11 includes a handle 20 and head 22. The head 22 is mounted on the shallow housing 24 which is integrally formed with the handle. The head in the embodiment shown carries three adjustable jaws 26 spaced equally about the head for radial movement with respect to the head axis 28. A pair of ratchet mechanisms 30 and 32 associated with head 22 are shown in FIG. 1. The ratchet mechanism 30 interconnects the handle 20 and housing 24 with the jaws so that rotation of the housing will cause the jaws 26 to turn the workpiece engaged by them. The ratchet mechanism 32 is used in adjusting the jaw positions so as to open and close them on the work. In the following description the various parts of the wrench are described in detail.

Figure 3:
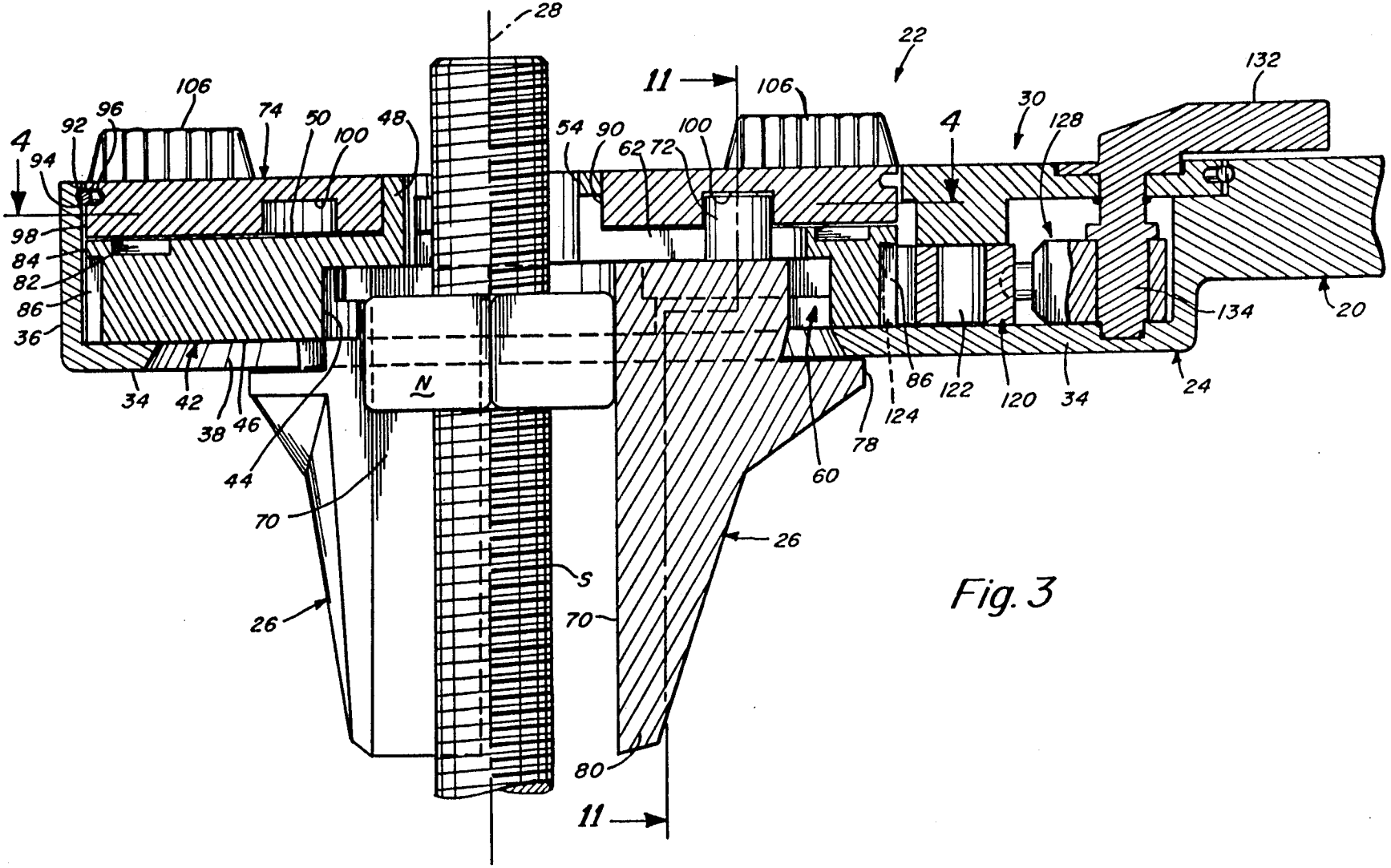
FIG. 3 is an enlarged fragmentary cross-sectional view of the head of the adjustable ratchet wrench shown in FIGS. 1 and 2.

The housing 24 most clearly shown in FIG. 3 has a bottom wall 34 and a peripheral side wall 36 that together define a shallow chamber within which the various parts of the head 22 are assembled. An opening 38 is provided in the bottom wall 34 of the housing concentric with the axis 28, and the housing is open at the top.

Figure 11:
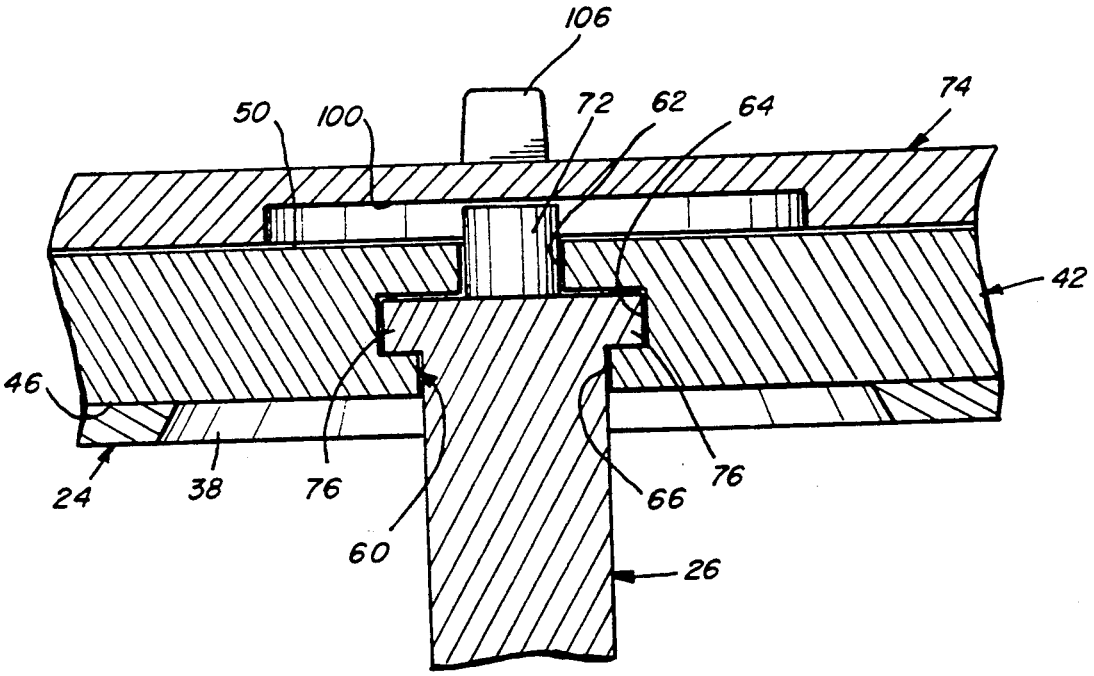
FIG. 11 is a fragmentary cross-sectional view of the head of the wrench taken along section line 11—11 in FIG. 3.

A first annular disk 42 is disposed in the housing 24 and has a central opening 44 extending upwardly from its bottom surface 46. A collar 48 extends upwardly from the upper surface 50 of the disk 42 and define an extension 54 of opening 44. The disk is provided with three radial slots 60 shown in FIGS. 3, 5, and 11, spaced equidistantly about the axis 28, and each terminates at its inner edge at the openings 44 and 54. As best shown in FIG. 11 each slot 60 includes an upper portion 62 that extends through the surface 50, a midsection 64 of greater width than the upper portion 62, and a lower portion 66 which is wider than the top portion 62 and narrower than the midsection 64. Each slot 60 carries a jaw 26 and permits the jaw to move radially in and out with respect to the axis 28.

Figure 7:
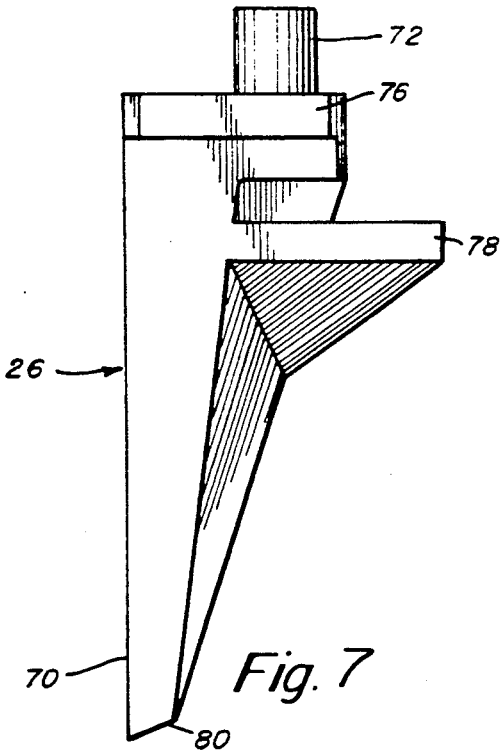
FIG. 7 is a side elevation view of one jaw of the wrench.
Figure 8:
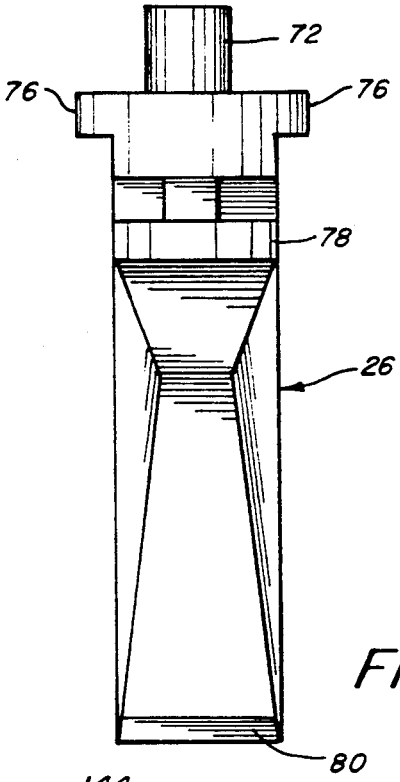
FIG. 8 is a rear view of the jaw shown in FIG. 7.

As shown in FIGS. 3 and 7 each of the jaws 26 has a gripping face 70 which may be knurled or otherwise textured so as to enable the jaw to firmly engage a workpiece such as a nut N to be turned by the wrench. Each jaw also includes a post 72 that extends upwardly at the top of the jaw and through the upper portion 62 of the slot 60 and is engaged by a cam disk 74 which is described in detail below. Beneath post 72 each jaw carries a pair of outwardly extending flanges 76 that are disposed in the midsection 64 of slot 60. The flanges 76 cooperate with the wider midsection 64 of the slot to retain the jaw in the first disk 42.

Each jaw 26 also includes a rear flange 78 that is disposed beneath the lower surface of housing bottom wall 34 and serves to close or cover the opening 38 when the jaws are closed. The rear flange 78 together with the side flanges 76 and the post 72 in the cam disk 74 prevent the jaw from pivoting or twisting with respect to the axis 28 and maintain the face 70 parallel to it. The lower portion 80 of each jaw is tapered to a minimum thickness at its lower end so as to enable the jaws to reach and engage a workpiece located in a confined area. The taper of the lower portion 80 of each jaw is clearly shown in FIGS. 1, 3 and 7. The gripping faces 70 are of uniform width throughout their full height.

The upper surface 50 of the first disk 42 is provided with a circular rack 82 about its periphery (see FIG. 5), which forms part of the second ratchet mechanism 32. The outer edge 84 of disk 42 is also provided with a circular gear 86 that forms part of the first ratchet mechanism 30. The ratchet mechanisms are also described in detail below.

The cam disk 74 is disposed in the chamber of housing 24 above the first disk 42 and is rotatable with respect thereto. The cam disk 74 has a central opening 90 that surrounds collar 48. The ca disk 74 serves as a cover for the chamber within the housing and is held in place by a retaining ring 92 which registers with opposed recesses 94 and 96 in the cylindrical wall 36 and the outer edge 98 of cam disk 74, respectively. Cam means in the form of three cam slots 100 in disk 74 overlie and cross the radial slots 60 in the first disk 42. The end 102 of each slot 100 lies closer to the head axis 28 than does the other end 104 cf each slot, and each slot receives the post 72 of one of the jaws 26. It is evident upon an inspection of FIGS. 3 and 4 that rotation of the cam disk 74 will cause the jaws to move radially in the slots 60 under the influence of the cam slots 100 acting on the posts 72. When the cam disk 74 is rotated clockwise as viewed in FIG. 4, the jaws will move radially outwardly away from the axis 28, while counter clockwise rotation will cause the jaws to move toward the axis. To facilitate rotation of the cam disk 74, a pair of thumb and finger engaging ribs 106 are provided on its upper surface (see FIGS. 1 and 3).

Figure 5:
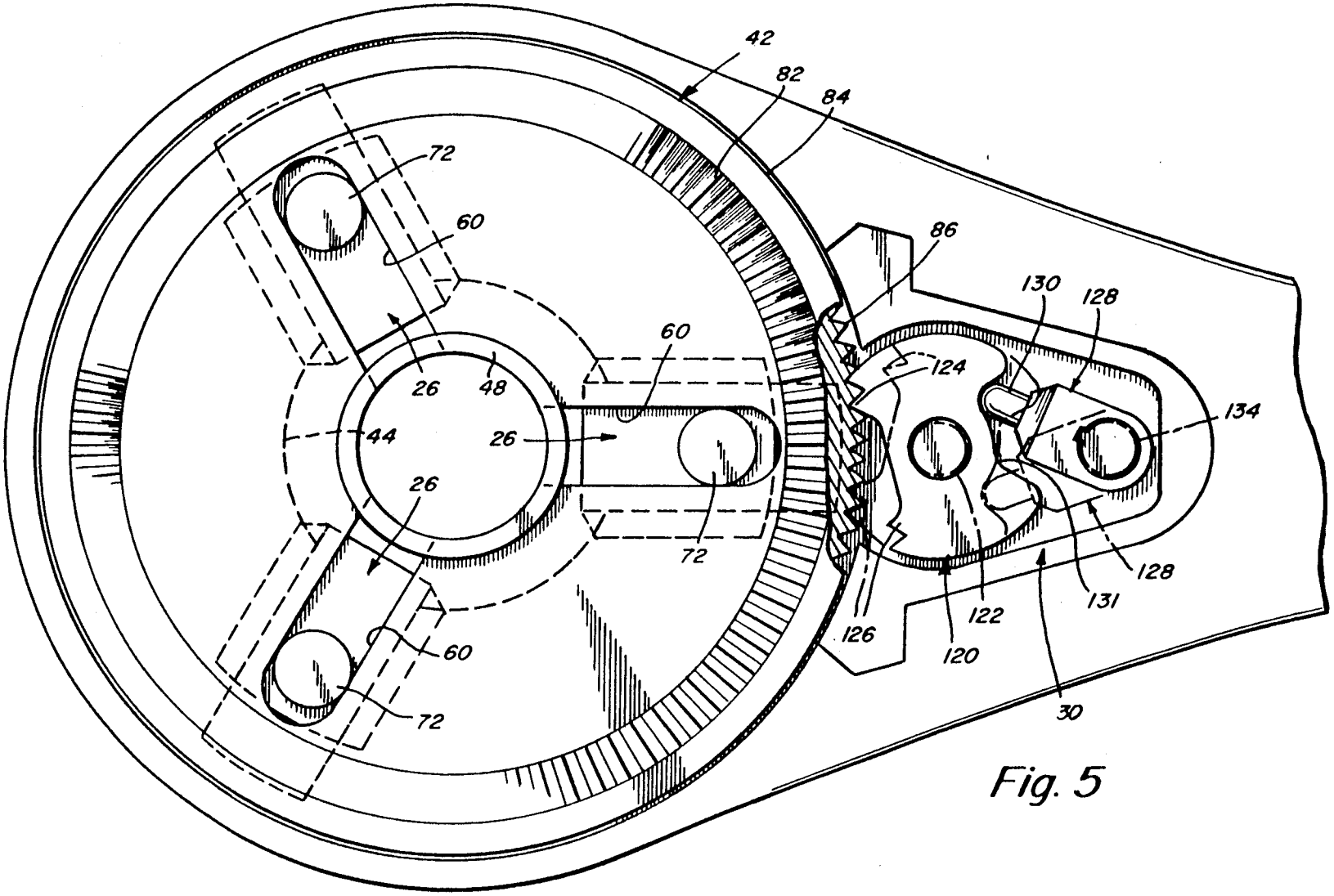
FIG. 5 is a plan view of the head of the wrench shown in FIG. 3 with the cam plate removed.
Figure 6:
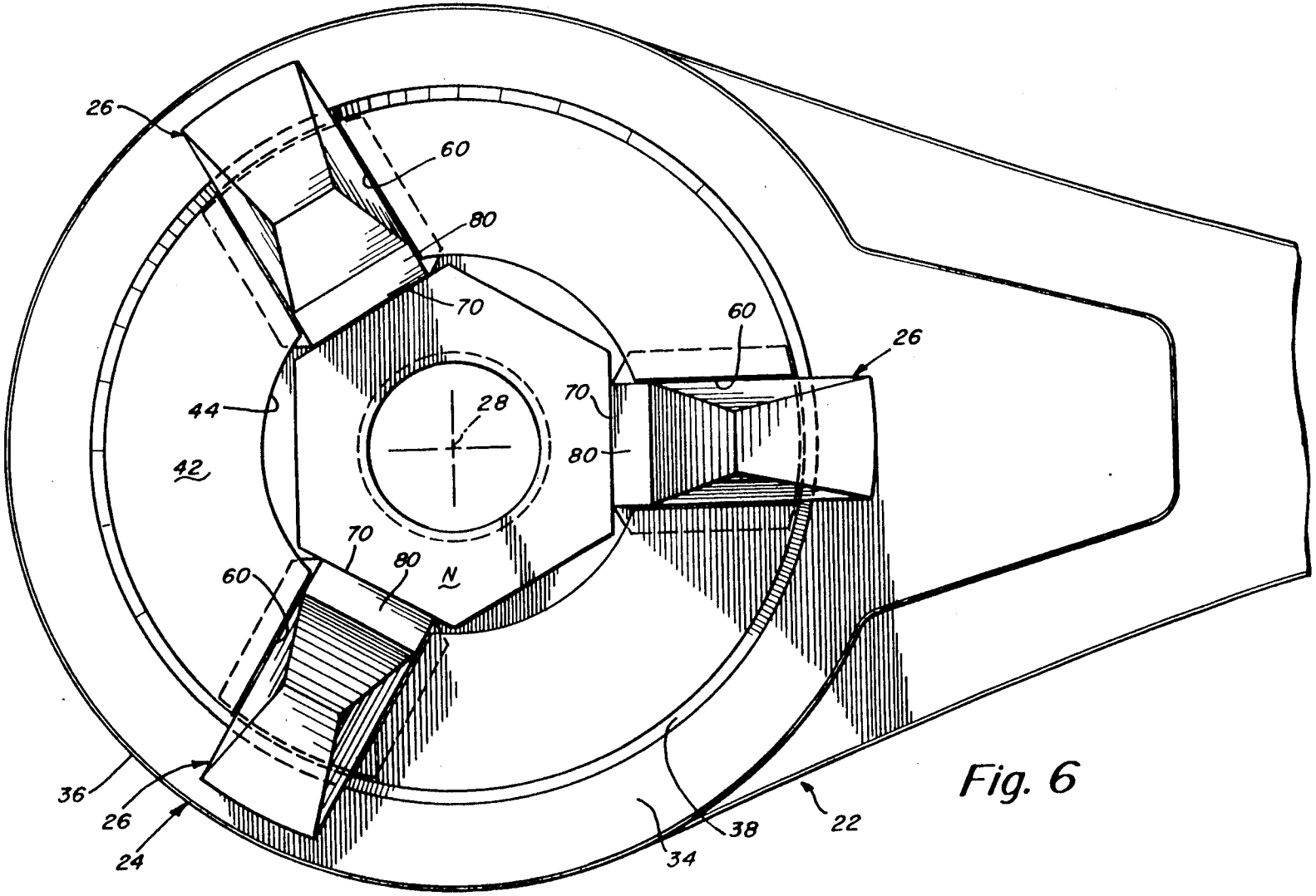
FIG. 6 is a bottom plan view of the head of the wrench showing the jaws of the wrench engaging a large hexagonal nut.

The first ratchet mechanism 30 selectively interconnects the housing 24 with the first disk 42 so that rotation of the housing may rotate the first disk which in turn will rotate the jaws about the axis 28 so that they may turn the workpiece such as nut N shown in FIGS. 3 and 6 to screw it on or off the threaded shaft S. The ratchet mechanism 30 is shown in FIGS. 3 and 5. The mechanism 30 includes a pawl 120 pivotally carried on a shaft 122 and having teeth 124 and 126 at each side that may selectively engage the circular gear 86 on the periphery of the first disk 42 The position of the pawl 120 is controlled by a detent 128 in turn controlled by the lever 132. The lever 132 has a stem 134 on which the detent 128 is keyed. The lever 132 as viewed in FIG. 1 is disposed above the end of handle 20 adjacent the working head 22 of the wrench.

The detent 128 carries a spring loaded plunger 130 that engages one or the other of the ends of slot 131 in the side of pawl 120 facing away from the circular gear 86. By pivoting the lever 132 between its two positions suggested in FIG. 2, the detent 128 with its plunger 130 may be moved between the two positions suggested in solid and broken lines in FIG. 5. When the pawl 120 is in the position shown in full lines in FIG. 5, counterclockwise rotation of the handle will cause the pawl to remain engaged with the gear 86 so that the first disk 42 will rotate with it. That action will in turn carry the jaws in the same direction and will rotate the work engaged by the jaws in a counterclockwise direction. With the pawl in the same position, clockwise rotation of the handle as viewed in FIG. 5 will cause the pawl to ride over the teeth as the plunger 130 moves in and out of the detent 128. Thus, the first disk 42 may be turned continuously in a counterclockwise direction by the handle 20, and the handle may click clockwise to enable the operator to reset the handled position. To rotate the first disk 42 in a clockwise direction, the position of the detent 128 is reversed by means of lever 132 so as to lie in the broken line position of FIG. 5. In that position, clockwise rotation of the handle 20 will cause the first disk 42 to rotate in the same direction, but the pawl 120 will be allowed to click over the circular gear 86 when the handle is turned counterclockwise. Thus, the operator may selectively position the ratchet mechanism so as to afford either clockwise or counterclockwise rotation of the nut N engaged by the wrench.

Figure 4:
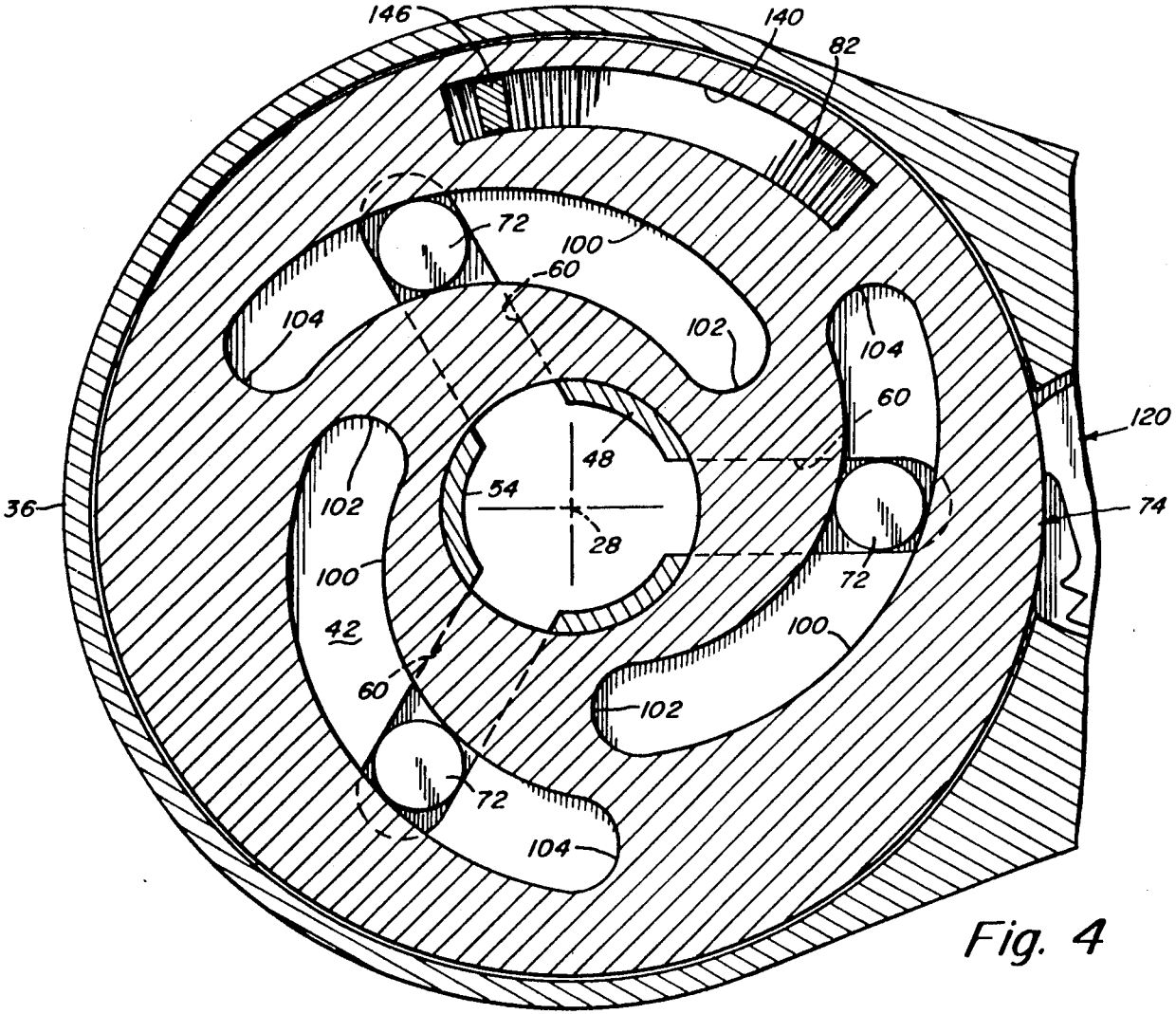
FIG. 4 is a fragmentary cross-sectional view of the head of the wrench taken along the section line 4—4 in FIG. 3.
Figure 9:
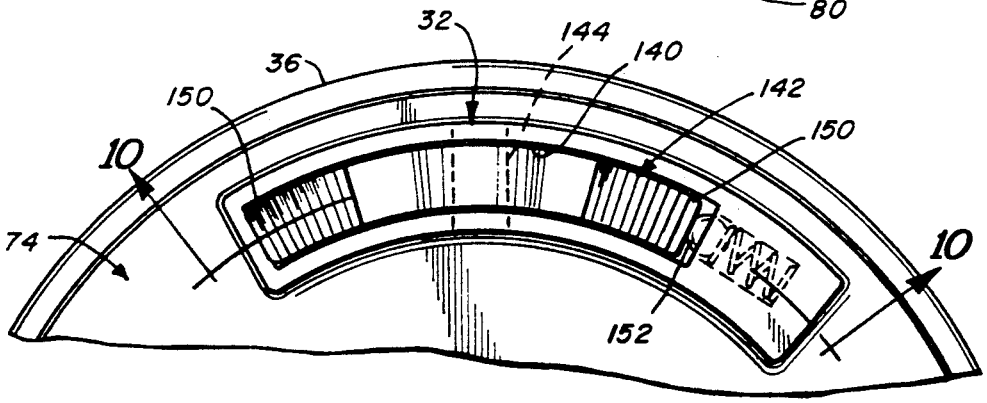
FIG. 9 is an enlarged fragmentary plan view of the head of the wrench and particularly slowing the ratchet control for the adjustment of the jaws.
Figure 10:
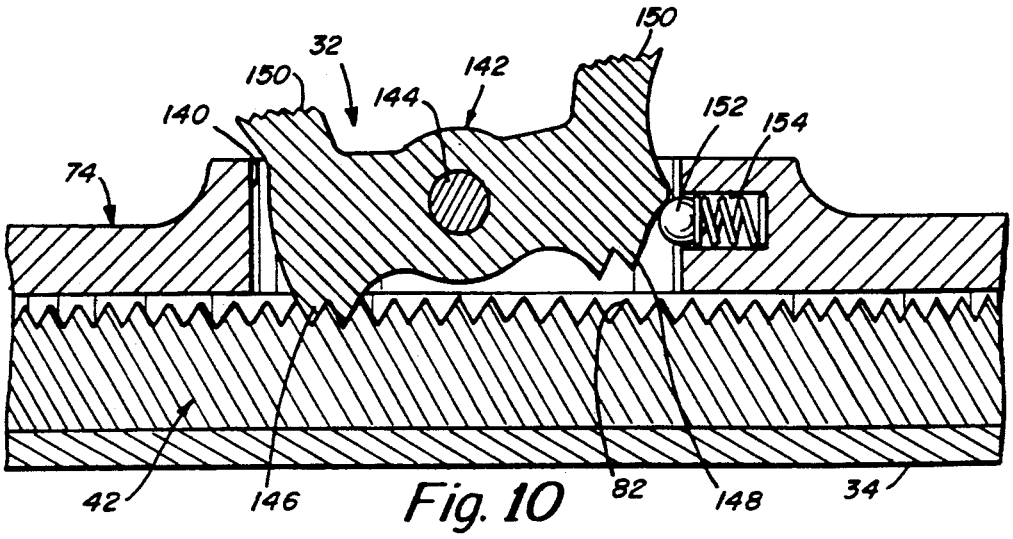
FIG. 10 is a fragmentary cross-sectional view of the ratchet control taken along the section line 10—10 in FIG. 9.

The second ratchet mechanism 32 is shown in FIGS. 4, 9 and 10. In FIG. 4 an arcuate slot 140 is shown provided in the cam disk 74. The slot 140 overlies the circular rack 82 on the upper surface of the first disk 42 and contains a locking pawl 142 which rocks on a horizontal shaft 144 that spans the slot 140. The locking pawl 142 has downwardly facing teeth 146 and 148 at its ends, which may selectively engage the teeth of the circular rack 82. A pair of knurled ears 150 are provided on the upper surface of the locking pawl 142 to facilitate pivoting of the pawl on its shaft 144. A ball detent 152 mounted in a recess 154 formed in the ca disk 74 at the end of slot 140, engages the right end of the locking pawl 142 as viewed in FIGS. 9 and 10.

With the locking pawl 142 in the position of FIG. 10 (teeth 146 engaging rack 82), the cam disk 74 may be rotated in a clockwise direction which will cause the jaws 26 to open. Moreover, in that position the jaws cannot be forced closed When the pawl 142 is reversed so that its teeth 148 engage the rack 82, the cam disk may be rotated counterclockwise to close the jaws on a workpiece. When the jaws engage the workpiece, with the pawl 142 remaining in the position wherein its teeth 148 engage the rack 82, the jaws will lock in place.

From the foregoing description, it is evident that the two easy-to-use ratchet mechanisms 30 and 32 conveniently accessible to the user enable the tool to rotate a workpiece either in a clockwise or counterclockwise direction and also permit the tool to be tightened onto and removed from the workpiece. The jaws 26 which extend beneath the head of the tool have an effective diameter very slightly greater than the set opening within the jaws and, therefore, the jaws are capable of engaging workpieces in remote locations having a minimum of clearance with other parts of the device on which the workpiece is being turned. Furthermore, the single adjustable ratchet wrench of this invention can very conveniently be made to accommodate the most popular size nuts and bolts such as from 5/16 inch to 1 inch as well as all the metric and standard sizes within the range. It will also be appreciated that because the tool is open at the center above the jaws, the threaded portion of a bolt onto which a nut is being turned may extend through the tool so as to give it the same versatility as a deep bolt socket.

Yet another advantage derived from this invention is that the tool has provides three jaws that firmly grip the work on its flat faces so as to eliminate the problem of wearing off the corners of the work or disturbing the work plating.

It will also be appreciated that the tool is particularly easy to operate because the three jaws are simultaneously adjusted by the ratchet system which also automatically locks the jaws in place when they engage the workpiece. And simply by reversing a control lever, the jaws may readily be opened so as to free the tool from the work.

The open center configuration of the head of the tool in combination with the adjustable locking jaws makes the tool particularly effective for use in combination with other tools. For example, a screwdriver having a hexagonal shaft may be inserted through the open jaws and the jaws may then be closed about the shaft. With the tool locked on the screwdriver in that manner, the screwdriver may be turned with one hand by means of the tool handle while the screwdriver itself may be steadied by the other hand of the user engaging the screwdriver handle. The tool of this invention may also be used in combination with standard square drive socket extension bars, sockets, or other square drive accessories by inserting their shafts through the tool head within the jaws and tightening the jaws on the shaft.

Finally, it will be appreciated that the tool of the present invention is capable of performing all the functions of conventional ratchet wrenches having separate heads for each size nut or bolt and both open and closed sockets. Thus, the present invention is capable of performing the work of ratchet wrenches that include approximately 82 different sockets ranging in size from 5/16 to 1 inch.

Figure 12:
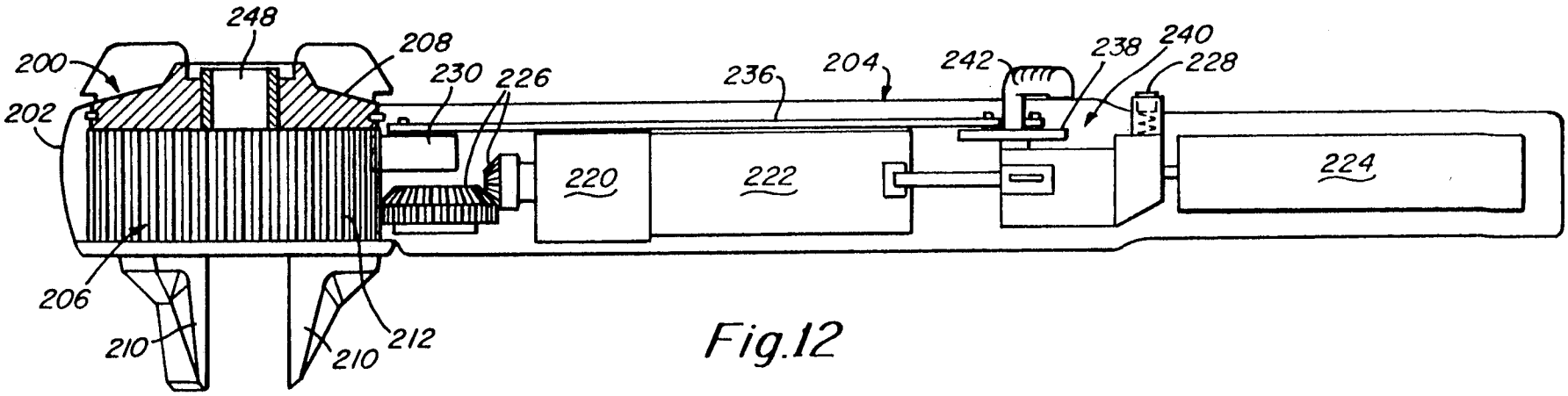
FIG. 12 is a side view of an adjustable power ratchet wrench that constitutes a second embodiment of this invention and showing somewhat schematically the mechanism in the handle of the tool.
Figure 13:
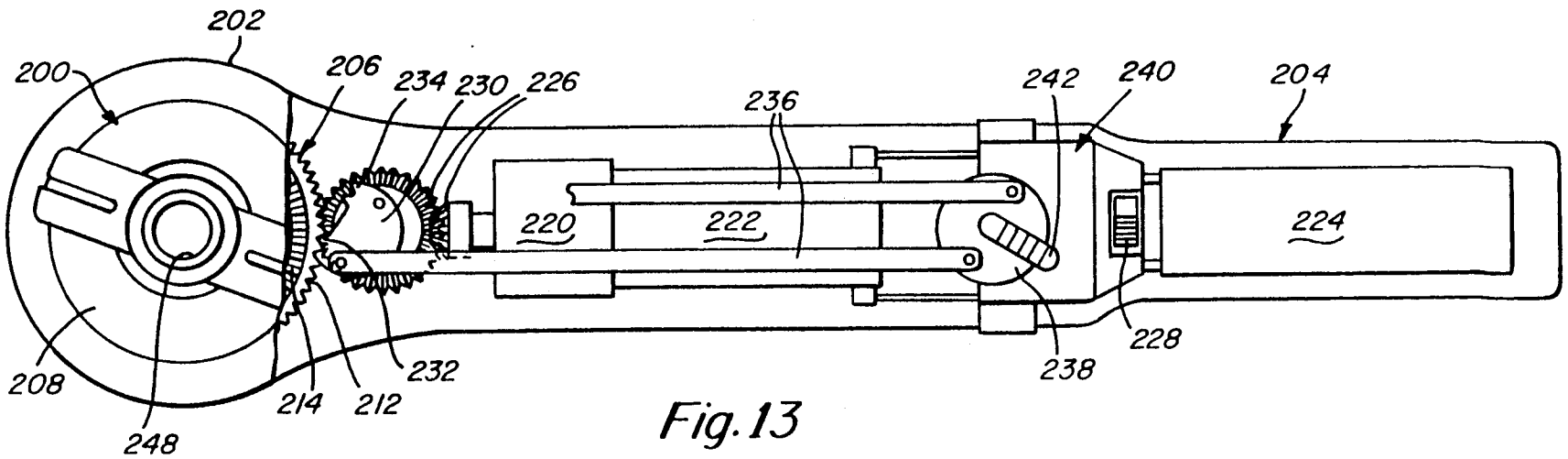
FIG. 13 is a plan view, partially broken away of the power driven wrench shown in FIG. 12.

In FIGS. 12 and 13, a second embodiment of the adjustable ratchet wrench is shown. This embodiment provides all of the advantages of the manually powered wrench shown in FIGS. 1–11, but in addition is motor powered. The head of the tool is essentially identical to the head of the first embodiment. However, the tool handle includes a power drive for rotating the head so as to turn the jaws and the work engaged by them. The power driven tool includes a head 200 mounted in housing 202 which in turn is rigidly connected to the handle 204. The head 200 includes a first disk 206, a second disk 208, and jaws 210 which may be identical to those corresponding part in the first embodiment. The first disk 206 has a circular gear 212 and a circular rack 214 that form part of the first and second ratchet mechanisms respectively that correspond to the first and second ratchet mechanisms 30 and 32 of the first embodiment. While the control for the second ratchet mechanism 32 is not shown in FIGS. 12 and 13, it is to be understood that the tool includes the same control and that the second ratchet mechanism operates in precisely the same fashion as described above in connection with the mechanism 32 of the first embodiment.

The power drive mounted in the handle 204 in the second embodiment includes a planetary gear reduction unit 220, DC motor 222 and rechargeable battery pack 224, all represented diagrammatically by boxes in the drawing.

The gear reduction unit 220 in turn is connected to a bevel gear drive 226 that engages the circular gear 212 of the first disk 206. A power switch 228 is provided to the circuit connecting the battery pack 224 to the DC motor for turning the power system on and off.

The pawl 230 which engages the circular gear 212 on the first disk 206 like the pawl 120 of the first embodiment has two sets of teeth 232 and 234 which ultimately engage the circular gear 212 to control the direction of rotation of the head 200. The position of the pawl 230 is in turn controlled by a pair of reversing arms 236 each connected at one end to the pawl 230 and at the other end to a disk 238 which forms part of a reversing switch assembly 240. The reversing switch assembly 240 also includes a finger level 242 for rotating the disk 238 to control the reversing arms. It is evident upon an inspection of FIG. 13 that when the lever 242 is in the position shown, the teeth 232 of pawl 230 engage the circular gear 212 and if the lever 242 is turned counterclockwise approximately 60° from the position shown, the teeth 232 of pawl 230 will disengage the circular gear and the teeth 234 will engage it. Just as in the first embodiment, with the pawl 230 in the position shown, clockwise movement of the handle 204 about the axis of the head 200 will cause the head to turn with the handle in that direction. However, if the handle is turned counterclockwise, the teeth 232 of pawl 230 will simply ride over the teeth of the circular gear 212, and the counterclockwise motion of the handle 204 will not be transmitted to the head. Similarly, if the finger lever 242 is reversed so as to cause the teeth 234 to engage the circular gear 212, counterclockwise rotation of the handle 204 will impart the same rotation to the head 200, but clockwise rotation of the handle will cause the teeth 234 to merely ride over the teeth of the circular gear and no rotation will be imparted to the head.

The finger lever 242 not only controls the position of the pawl 230 but also reverses the polarity of the DC motor 222 so as to change the direction of rotation of the motor. In order to cause the motor 222 to drive the circular gear 212 and head 200, the position of the pawl 230 must be coordinated with the motor rotation direction.

The reversing switch assembly 240 may also include charging contacts (not shown) for recharging the battery pack 224. The details of that device are well known in the art and do not in themselves form part of the present invention The power driven tool shown in FIGS. 12 and 13 may be operated either manually or automatically by the power system in the following manner. If the tool is to be operated manually, the power switch 228 remains in the off position, and the position of the pawl 230 is controlled by the finger lever 242. The jaws 210 are opened and closed by the setting of the first ratchet mechanism (not shown) just as described in connection with the first embodiment. When the wrench is to be automatically powered by the DC motor 220 and battery pack 224, the jaws 210 are first tightened on the workpiece in the manner described in connection with the first embodiment. The position of the pawl 230 and the direction of rotation of the motor 222 are set by means of the finger lever 242, and the motor is turned on by means of the power switch 228. When the power switch 228 is moved to the on position, the motor 222 drives the first disk 206 through the beveled gear drive 226 and the circular gear 212, which causes the head 200 to rotate and turn the work engaged by the jaws 210. If the nut is being turned to tighten it on the shaft, the nut will run down on the shaft until it stops by engaging a resistive force greater than the force of the motor. At that point, the operator may turn the power switch off and if desired may further tighten the nut on the shaft by continuing to turn the head 200 manually by driving the handle 204. Thereafter, to remove the wrench from the workpiece, the operator simply reverses the position of the second ratchet (not shown) so as to open the jaws manually by rotating the second disk 208.

An important feature of the power driven ratchet wrench of FIGS. 12 and 13 is its ability to drive a screw driver attachment (not shown) that may be inserted through the open center 248 in the same manner as in the first embodiment. The operator may simply stabilize the screw driver with one hand while operating the power switch 228 with the other. In the power mode, the ratchet wrench will drive the screw driver until the screw being turned encounters sufficient resistance to overcome the force of the motor drive. If additional tightening is required, this may be accomplished by hand by rotating the handle 204 of the ratchet wrench in the manner described above.

The power tool will adjust to different nut and bolt sizes in the same manner as the wrench of the first embodiment. Thus, the requirement for providing a range of standard and metric sockets is eliminated.

From the foregoing description those skilled in the art will appreciate that numerous modifications may be made of this invention without departing from its spirit. Therefore, it is not intended that the breadth of this invention be limited to the single embodiment illustrated and described. Rather, it is intended that the scope of this invention be determined by the appended claims and their equivalents.

I claim:

1. An adjustable ratchet wrench comprising a housing having a handle extending from one side thereof for rotating the housing, said housing having a generally cylindrical chamber therein with its axis generally perpendicular to the plane of the handle, a first disk mounted concentrically in the housing and rotatable with respect thereto about the axis, a first ratchet mechanism interconnecting the housing and the first disk enabling the first disk to be selectively locked to the housing for clockwise or counterclockwise rotation therewith about the axis, a plurality of radially oriented slots in the disk and a jaw slideably mounted in each slot to move radially inwardly and outwardly in the slot, each of said jaws having a gripping surface facing the axis, a second disk disposed concentrically in the housing and rotatable with respect to the housing and first disk, said second disk having a plurality of cam slots that correspond in number to the radial slots in the first disk, said cam slots each having an inner end that lies closest to the axis and an opposite end that lies farthest away from the axis, a stem carried by each of the jaws and extending into one of the cam slots whereby rotation of the second disk relative to the first disk in one direction closes the jaws and in the other direction opens the jaws, a second ratchet mechanism connecting the second disk with the first disk enabling the second disk to rotate selectively either clockwise or counterclockwise with respect to the first disk to open or close the jaws, a motor in the handle, a gear drive in the housing driven by the motor and connected to the first disk for rotating the first disk independent of the housing, and means operatively connected to the motor and gear drive for reversing the direction in which the motor rotates the first disk independent of the housing.

2. A wrench as defined in claim 1 wherein the means operatively connected to the motor and gear drive includes reversing means connected to the motor for changing its direction of rotation.

3. A wrench as defined in claim 1 wherein a battery is mounted in the handle for driving the motor.

4. A wrench as defined in claim 2 wherein the first ratchet mechanism includes a circular disk on the first disk engaged by the gear drive for rotating the first gear by the motor.

5. A wrench as defined in claim 4 wherein the reversing means includes a switch mounted in the handle for reversing the polarity of the motor, and means interconnecting the switch and the first ratchet mechanism for changing the direction of rotation of the first disk when the motor polarity is reversed.

6. An adjustable ratchet wrench comprising a housing having a handle extending from one side thereof for rotating the housing, said housing having a generally cylindrical chamber therein, a first disk mounted concentrically in the housing and rotatable with respect thereto about the axis of the housing, a first mechanism interconnecting the housing and the first disk enabling the first disk to be selectively locked to the housing for clockwise or counterclockwise rotation therewith about the axis, a plurality of jaws slideably mounted in the first disk to move radially inwardly and outwardly in said disk, each of said jaws having a gripping surface facing the axis, a second disk disposed in the housing and rotatable with respect to the housing and first disk, said second disk having a plurality of cam means that correspond in number to the jaws, said cam means each having an inner portion that lies closest to the axis and an outer portion that lies farthest away from the axis, means carried by each of the jaws and engaging one of the cam means whereby rotation of the second disk relative to the first disk in one direction closes the jaws and in the other direction opens the jaws, a second mechanism connecting the second disk with the first disk enabling the second disk to rotate selectively either clockwise or counterclockwise with respect to the first disk to open or close the jaws, a motor in the handle, a gear drive in the housing driven by the motor and connected to the first disk for rotating the first disk independent of the housing, and means operatively connected to the motor and gear drive for reversing the direction in which the motor rotates the first disk independent of the housing.

7. A wrench as defined in claim 6 wherein the means operatively connected to the motor and ear drive includes reversing means connected to the motor for changing its direction of rotation.

8. A wrench as defined in claim 6 wherein a battery is mounted in the handle for driving the motor.

9. A wrench as defined in claim 7 wherein the first mechanism includes a circular gear on the first disk engaged by the gear drive for rotating the first gear by the motor.

10. A wrench as defined in claim 9 wherein the reversing means includes a switch mounted in the handle for reversing the polarity of the motor, and means interconnecting the switch and the first mechanism for changing the direction of rotation of the first disk when the motor polarity is reversed.

11. An adjustable ratchet wrench comprising a housing having a handle extending therefrom for rotating the housing, said housing having a generally cylindrical chamber therein with its axis disposed at an angle to the plane of the handle, a first member mounted concentrically with respect tot he housing and rotatable with respect thereto about the axis, a mechanism interconnecting the housing and the first member enabling the first member to be selectively locked to the housing for clockwise or counterclockwise rotation therewith about the axis, a plurality of jaws mounted in the chamber, each of said jaws having a gripping surface facing the axis, means provided in the first member and the jaws confining movement of the jaws with respect to the member to a radial direction, a second member disposed concentrically with respect to the housing and rotatable with resect to the housing and first member, said second member having a plurality of cam means that correspond in number to the number of jaws, said cam means each having an inner end that lies closest to the axis and an opposite end that lies farthest away from the axis, cam means carried by each of the jaws and engaging one of the cam means in the second member whereby rotation of the second member relative to the first member in one direction closes the jaws and in the other direction opens the jaws, a motor in the handle, a gear drive in the housing driven by the motor and connected to the first member for rotating the first member independent of the housing for turning the jaws about the axis, and means operatively connected to the motor and gear drive for reversing the direction in which the motor rotates the first member independent of the housing.

12. A wrench as defined in claim 11 wherein the means operatively connected to the motor and gear drive includes reversing means connected to the motor for changing its direction of rotation.

13. A wrench as defined in claim 11 wherein a batter is mounted in the handle for driving the motor.

14. A wrench as defined in claim 12 wherein the mechanism includes a circular gear on the first member engaged by the gear drive for rotating the first member by the motor.

15. A wrench as defined in claim 14 wherein the reversing means includes a switch mounted in the handle for reversing the polarity of the motor, and means interconnecting the switch and the mechanism for changing the direction of rotation of the first member when the motor polarity is reversed.

16. A wrench as defined in claim 11 wherein the means provided in the first member and jaws comprises a plurality of tracks in sad member each engaging one of the jaws.

17. A wrench as define din claim 11 wherein the cam means in the second member comprise slots that engage the jaws.

18. A wrench as defined in claim 16 wherein the cam means in the second member comprise slots that engage the jaws.

19. A wrench as defined in claim 16 wherein the means operatively connected to the motor and gear drive includes reversing means connected to the motor for changing its direction of rotation.

20. A wrench as defined in claim 16 wherein a battery is mounted in the handle for driving the motor.

21. A wrench as defined in claim 19 wherein the mechanism includes a circular gear on the first member engaged by the gear drive for rotating the first member by the motor.

22. A wrench as defined in claim 21 wherein the reversing means includes a switch mounted in the handle for reversing the polarity of the motor, and means interconnecting the switch and the mechanism for changing the direction of rotation of the first member when the motor polarity is reversed.

23. An adjustable ratchet wrench comprising a housing having a handle extending therefrom for rotating the housing, said housing having a generally cylindrical chamber therein with a central axis, a first member mounted on the housing and rotatable with resect thereto about the axis, a mechanism interconnecting the housing and the first member enabling the first member to be selectively locked to the housing for clockwise or counterclockwise rotation therewith about the axis, a plurality of jaws mounted in the chamber, each of said jaws having a gripping surface facing the axis, means provided in the first member and the jaws confining movement of the jaws with respect to the member to a radial direction, a second member disposed on the housing and rotatable with respect to the housing and first member, said second member having a plurality of cam means that correspond in number to the number of jaws, said cam means each having an inner portion that lies closest to the axis and an outer portion that lies farthest away from the axis, cam means carried by each of the jaws and engaging one of the cam means in the second member whereby rotation of the second member relative to the first member in one direction closes the jaws and in the other direction opens the jaws, a motor in the handle, a gear drive in the housing driven by the motor and connected to the first member for rotating the first member independent of the housing for turning the jaws about the axis, and means operatively connected to the motor and gear drive for reversing the direction in which the motor rotates the first member independent of the housing.

* * * * *